United States Patent [19]

Kilbourn et al.

[11] 4,008,532

[45] Feb. 22, 1977

[54] SKI BOOT

[75] Inventors: Lawrence Layton Kilbourn, Middletown, Conn.; Robert Brunkhorst, Nashua, N.H.

[73] Assignee: Olin Corporation, New Haven, Conn.

[22] Filed: July 12, 1976

[21] Appl. No.: 704,213

[52] U.S. Cl. ..... 36/120

[51] Int. Cl.² ..... A43B 5/04

[58] Field of Search ..... 36/120, 121, 105

[56] References Cited

UNITED STATES PATENTS

| | | | |
|---|---|---|---|
| 3,713,231 | 1/1973 | Mochizuki | 36/121 |
| 3,868,783 | 3/1975 | Caporicci | 36/120 |
| 3,886,673 | 6/1975 | Check et al. | 36/121 |

*Primary Examiner*—Patrick D. Lawson

*Attorney, Agent, or Firm*—Donald R. Motsko; William W. Jones

[57] ABSTRACT

A ski boot of the rear or modified top entry variety which has a rear part hingedly connected to the remainder of the boot. The rear part is pivoted away from the remainder of the boot to permit the wearer to put the boot on or take it off. The hinge is in the form of a laterally extending T-shaped mating slot and flange combination. The stem of the flange is flexible and helps to accommodate the pivotal movement.

4 Claims, 5 Drawing Figures

6
56
4

4
5
42
46
48
6
5

4
40
42
56
46
44
26
56
28
50
52
48
54
8
6

SKI BOOT

This invention relates to a ski boot of the rear or modified top entry variety, and more particularly to the hinge structure which permits opening and closure pivoting of the primary components of the boot to occur.

Ski boots of the rear or modified top entry variety are generally known in the prior art and are characterized by having a rear part that is hinged to the remainder of the boot and is pivotable rearwardly with respect to the remainder of the boot to temporarily enlarge the top opening in the boot to permit one to put on or take off the boot. While being worn, the rear part is held tightly against the rest of the boot by closure means, such as straps or the like.

Rear or modified top entry ski boots have used a variety of hinge constructions, such as pins extending through the heel laterally, rivets on both sides of the heel, and other similar metal fastenings. Hinges of this type have demonstrated a tendency to bend or fail when subjected to normal usage.

Boots sold under the Hanson trademark have been made with a hinge construction which is formed integrally and in one piece with the rear part of the boot. These boots are made of plastic and the rear part includes a lower tongue or projecting part having a dovetail cross-section and a downwardly projecting lug forming a catch which prevents accidental removal of the tongue from a mating recess formed in the heel of the boot. The tongue extends axially of the boot into the matching recess formed in the boot heel portion. The geometry of this hinge construction requires the main portion of the boot which contains the recess to be formed in mating halves which must be later joined together to form the main boot portion.

The hinge of this invention is of simplified construction, easily molded, and having components formed entirely of the same material as the boot. The hinge components are made integral with the boot and are arranged for simple assembly. The hinge relies primarily on the inherant resiliency of the boot material to permit the pivoting to occur. The boot material is preferably polyurethane plastic, however other plastics possessing inherant resiliency can also be used without departing from the spirit of the invention.

The hinge of this invention has two basic mating components, a male member formed on one part of the boot, and a matching female formed on the other part of the boot. The hinge is preferably located in the heel area of the boot and is assembled by inserting the male member into the female member and sliding the mating components laterally relative to each other and perpendicular to the vertical plane of general symmetry of the boot.

It is, therefore, an object of this invention to provide a ski boot of the rear or modified top entry variety having an improved hinge connection between the two primary parts of the boot.

It is a further object of this invention to provide a ski boot of the character described wherein the hinge is formed from the same material as the boot.

It is yet another object of this invention to provide a ski boot of the character described wherein the hinge has complimentary male and female components which may be easily molded when the boot parts are molded, and which may be quickly and easily assembled.

It is yet another object of this invention to provide a ski boot of the character described wherein the hinge has complimentary male and female components which make it easy to interchange the entire rear member to accommodate snow conditions, skiing technique, skiing ability etc.

These and other objects and advantages of the ski boot of this invention will become more readily apparent from the following detailed description of a preferred embodiment of the invention taken in conjunction with the accompanying drawings, in which.

Figure 1:
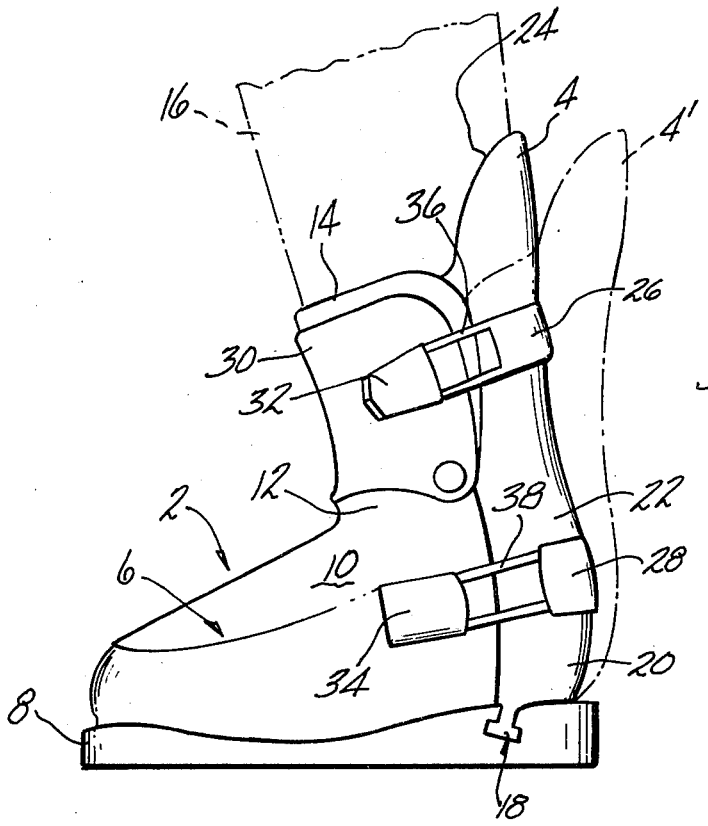
FIG. 1 is a side elevational view of a preferred embodiment of a ski boot formed in accordance with this invention.
Figure 2:
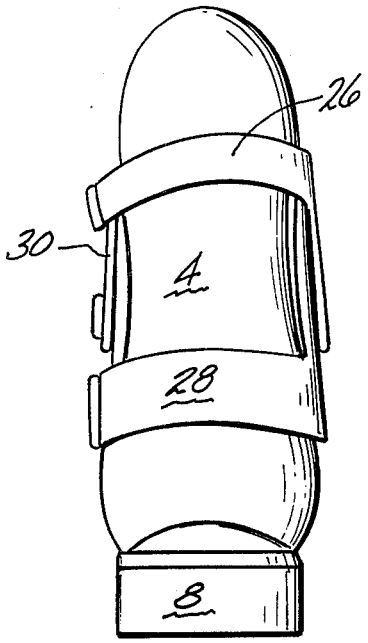
FIG. 2 is a rear elevational view of the boot of FIG. 1.

Referring now to the drawings, there is shown in FIG. 1 a ski boot 2 which is of the type having a rear member 4 hinged to a front member 6 for pivotal movement away therefrom to allow insertion of the wearer's foot, and return theretoward for securement to the foot. This type of boot can be termed a "rear entry" boot or a "modified top entry" boot, depending on the extent of pivotal movement the rear member 4 is free to make with respect to the front member 6. The front member has a sole part 8, an instep part 10, a front ankle-covering part 12, an an upper terminus or top 14 which extends above the wearer's ankle to snugly engage the front of the lower part of the wearer's lower leg 16 (shown in phantom). The rear part 4 is hinged to the sole 8 at the hinge denoted generally by the numeral 18. The rear part 4 includes a heel covering portion 20, a rear ankle covering portion 22, and an upper terminus or top 24 which snugly engages the rear of the lower part of the wearer's leg 16. It will be understood that there is shown in the drawings only the outer shell part of the boot 2 and that an inner resilient liner or pads are usually disposed inside of the shell and actually contact the wearer's leg. The liner or pads are not shown for purposes of clarity and simplicity.

The boot 2 is shown in FIG. 1 in its closed position secured to the wearer's foot. The rear member 4 is held in the closed position by a pair of straps 26 and 28 which are respectively secured to a cuff 30 and the front member 6. The cuff 30 is in turn secured to the front member 6. A pair of buckles 32 and 34 are mounted on the cuff 30 and front member 6 respectively and releasably engage cable loops 36 and 38 secured to the straps 26 and 28 respectively. To insert or remove the foot from the boot, the buckles 32 and 34 are opened and the straps 26 and 28 are loosened and the rear member 4 is pivoted backward to the position 4' (shown in phantom) to permit passage of the foot through the top opening of the boot.

Figures 3, 4, 5:
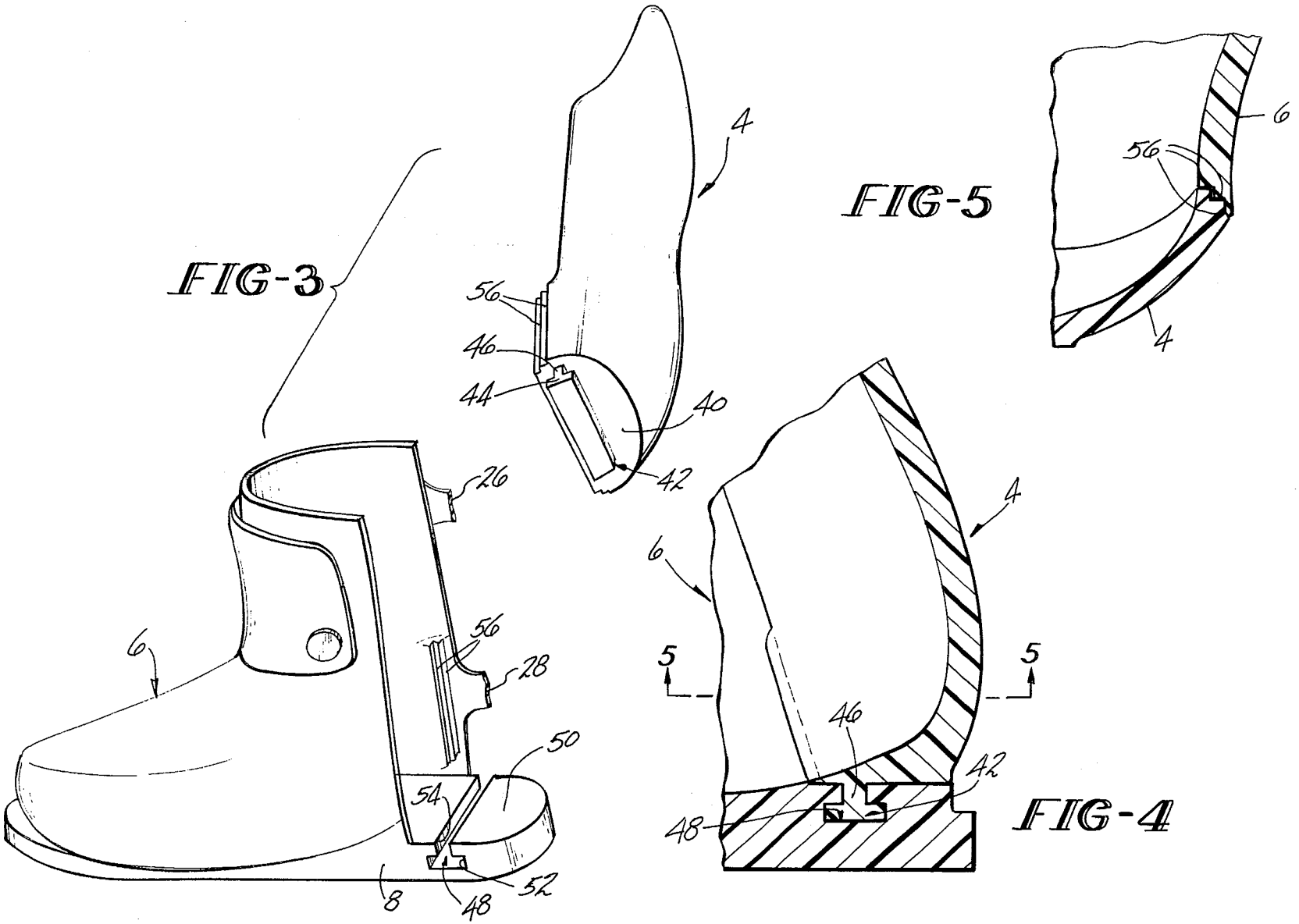
FIG. 3 is an exploded perspective view of the boot of FIG. 1 with extraneous parts removed for clarity.
FIG. 4 is a fragmented sectional view of the heel part of the boot showing the hinge and taken along the vertical plane of general symmetry of the boot.
FIG. 5 is a fragmented horizontal sectional view of the heel part of the boot taken along line 5—5 of FIG. 4.

Referring now to FIGS. 3–5, details of the construction of the hinge 18 are shown. The bottom exterior surface 40 of the rear part 4 of the boot is formed with an integral downwardly depending projection 42 which has its major dimension extending in a lateral direction with respect to the major dimension of the boot. Thus the projection 42 is elongated in a direction which is normal to a vertical plane of general symmetry of the boot. The projection includes a head part 44 at its lower end and a stem part 46 which connects the head 44 with the remainder of the rear boot part 4. The head part 44 is enlarged with respect to the stem 46 in a direction which is perpendicular to the direction of the major dimension of the projection 42. The preferred shape of the projection 42 is T-shaped, however other configurations could be equally operative.

In the heel area of the sole 8 of the front boot part 6, there is formed a transversely extending open ended groove 48 which opens upwardly through the top surface 50 of the sole. The groove 48 has the same cross-sectional configuration as the projection 42 and includes an enlarged basal portion 52 opening into a restricted mouth 54.

To connect the rear boot part 4 to the front boot part 6, one merely inserts the projection 42 into the groove 48 from the side of the boot and slides the rear part 4 laterally of the front part 6 until the projection 42 is contained fully within the groove 48. The hinge connection is most clearly shown in FIG. 4. The inherant resiliency of the material from which the rear boot part 4 is made permits the rear part 4 of the boot to pivot rearwardly about the hinge 18 sufficiently to enable one to put the boot on or take it off. Elastic deformation occurs principally in the area of the stem 46 and above the lower surface 40 of the rear boot part 4 as the part 4 is pivoted rearwardly. At the same time, the hinge 18 holds the part 4 against being upwardly disengaged from the front boot part 6. Disengagement can only be accomplished by lateral movement between the two parts of the boot, which movement does not occur during normal handling or wearing of the boot.

Referring now to FIGS. 3 and 5, there is shown a plurality of matching steps 56 formed in the rear vertical edge of the boot front part 6 and the forward vertical edge of the boot rear part 4. These steps 56 provide for nesting of the rear part 4 within the front part 6 and limit the extent of forward and lateral outward movement that the rear part 4 of the boot may incur. These steps 56 thus provide for a more solid interface between the boot parts 4 and 6 when the boot is worn.

It will be readily appreciated that the boot constructed in accordance with this invention will provide a simple hinging mechanism which is quite reliable in operation, tough and durable, easily assembled and disassembled but not accidentally disruptable. Furthermore, the boot shell can be easily molded with the hinge components being integral and in one piece with the shell parts. This eliminates the necessity of using additional metal hinge pins or the like and actually provides a better hinge than one using metal parts.

Since many changes and variations of the disclosed embodiment of the invention may be made without departing from the inventive concept, it is not intended to limit the invention otherwise than as required by the appended claims.

What is claimed is:

1. In a ski boot of the rear or modified top entry variety which includes a plastic shell having a forward part and a rearward part hingedly connected together, a hinge structure comprising: a projection formed in one piece with and of the same material as one of said boot parts, said projection having a major dimension which extends transversely of the boot and said projection having a basal stem part of restricted thickness, when measured perpendicularly to said major dimension, merging with a terminal head part of expanded thickness, when measured perpendicularly to said major dimension; and a groove in the other of said parts, said groove extending transversely of the boot and having an open mouth of restricted dimension through which said stem extends, and an enlarged bottom part in which said head is disposed, said mouth being sufficiently restricted to prevent said head from being passed therethrough in a direction to disconnect said one boot part from said other boot part.

2. The ski boot hinge structure of claim 1, wherein said groove is provided with at least one open end through which said projection can be passed to disconnect said one boot part from said other boot part, said open end being disposed in a lateral side surface of the boot shell.

3. In a ski boot of the rear or modified top entry variety which includes a plastic shell having a forward part and a rearward part, said parts being hinged together for relative movement enabling a wearer to don or remove the boot, a hinge structure comprising adjacent contacting surfaces on said forward and rearward boot parts in the area of the heel of the boot; a male member formed on one of said boot parts and projecting therefrom toward the other of said boot parts, said male member being formed in one piece and the same material as said one boot part and extending transversely of the boot; a groove formed in the other of said boot parts extending transversely of the boot, said male member being disposed in said groove, said groove having an open mouth through which said male member extends and at least one open end extending through a side surface of the boot, said open end providing the only means by which said male member can be withdrawn from said groove, there being means preventing withdrawal of said male member from said groove by way of said open mouth.

4. In a ski boot of the rear or modified top entry variety which includes a plastic shell having forward and rearward parts hingedly connected together for relative movement enabling one to don or remove the boot, a hinge structure comprising: a projection formed on one of said boot parts and protruding toward the other of said boot parts, said projection extending transversely of the boot and being formed of the same material and in one piece with said shell; a groove formed in the other of said boot parts and extending transversely of the boot, said groove having an open mouth through which said projection passes and having at least one open end in a side wall of the boot shell, said projection being freely slidable through said groove, in a direction normal to a plane containing said open end whereby said projection can be withdrawn from said groove through said open end; means preventing said projection from being withdrawn from said groove through said open mouth; and said groove and said projection being positioned in the general heel area of the boot shell.

* * * * *

UNITED STATES PATENT OFFICE

CERTIFICATE OF CORRECTION

Patent No. 4,008,532 Dated February 22, 1977

Inventor(s) Lawrence Layton Kilbourn and Robert Brunkhorst

It is certified that error appears in the above-identified patent and that said Letters Patent are hereby corrected as shown below:

Col. 1, line 50, insert "member" after the word female;

Col. 2, line 34, change "an" (first occurrence) to -- and --.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*